US005848729A

United States Patent [19]

Thornton

[11] Patent Number: 5,848,729

[45] Date of Patent: Dec. 15, 1998

[54] ACCESSORY NOZZLE FOR WHIPPED CREAM DISPENSERS

[76] Inventor: Terry Thornton, 323 E. Wilson Ave., Orange, Calif. 92867

[21] Appl. No.: 839,355

[22] Filed: Apr. 17, 1997

Related U.S. Application Data

[60] Provisional application No. 60/019,878 Jun. 17, 1996.

[51] Int. Cl. [6] ..... B67D 5/58

[52] U.S. Cl. ..... 222/190; 222/402.21; 99/516

[58] Field of Search ..... 222/78, 190, 402.13, 222/402.21, 402.22, 402.23; 99/516

[56] References Cited

U.S. PATENT DOCUMENTS

| | | | |
|---|---|---|---|
| 3,178,060 | 4/1965 | Bossack | 222/78 |
| 3,954,208 | 5/1976 | Brill | 222/402.23 |
| 4,509,641 | 4/1985 | Scieri et al. | 206/219 |
| 4,856,684 | 8/1989 | Gerstung | 222/402.23 |
| 5,167,347 | 12/1992 | Wiegner et al. | 222/402.21 |

*Primary Examiner*—Joseph A. Kaufman
*Attorney, Agent, or Firm*—Goldstein & Canino

[57] ABSTRACT

An accessory nozzle for attachment onto a whipped cream can having a top and a dispensing outlet extending from the top, comprising a nozzle shell having a nozzle shell wall defining a nozzle interior. The nozzle shell has an entrance opening which fits snugly over the dispensing outlet, and an exit opening having nozzle fingers. A plurality of coloring and flavoring nodules are disposed in the nozzle shell wall and are directed toward the nozzle interior to color and flavor whipped cream passing through the nozzle interior toward the exit opening. Each nodule corresponds directly to one of the nodule fingers.

20 Claims, 4 Drawing Sheets

ACCESSORY NOZZLE FOR WHIPPED CREAM DISPENSERS

This application claims priority from provisional patent appln. No. 60/019,878 filed Jun. 17, 1996.

BACKGROUND OF THE INVENTION

The invention relates to an accessory nozzle for whipped cream dispensers. More particularly, the invention relates to a nozzle that attaches onto a conventional pressurized whipped cream dispensing can, and adds coloring or flavoring to the whipped cream as it is dispensed.

Conventional whipped cream is commonly available in a pressurized can which holds a prepared white cream product, which is propelled by nitrous oxide. The whipped cream can has a dispensing outlet which extrudes the fluffy white product.

Whipped cream is sometimes also available with chocolate flavoring and coloring, wherein the chocolate additive is pre-mixed into the whipped cream. Consumers, especially children, find variety in flavoring and coloring highly desirable. However, because of the increased cost of marketing, producing, and distributing multiple versions of essentially the same product, manufacturers have refrained from offering whipped cream cans with different flavors.

SUMMARY OF THE INVENTION

It is an object of the invention to produce an accessory nozzle which attaches onto the pre-existing nozzle of a conventional whipped cream can.

It is another object of the invention that the accessory nozzle introduces flavoring and coloring into the whipped cream product as it is being dispensed.

It is a further object of the invention that a variety of different flavorings and colorings can be introduced at the same time into the stream of whipped cream being dispensed.

It is a still further object of the invention that the invention employs a plurality of flavor nodules which can be interchanged to alter the flavoring and coloring characteristics of the accessory nozzle, and to replace flavor nodules once all of their flavoring and coloring substrate has been used.

The invention is an accessory nozzle for attachment onto a whipped cream can having a top and a dispensing outlet extending from the top, comprising a nozzle shell having a nozzle shell wall defining a nozzle interior. The nozzle shell has an entrance opening which fits snugly over the dispensing outlet, and an exit opening having nozzle fingers. A plurality of coloring and flavoring nodules are disposed in the nozzle shell wall and are directed toward the nozzle interior to color and flavor whipped cream passing through the nozzle interior toward the exit opening. Each nodule corresponds directly to one of the nodule fingers.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
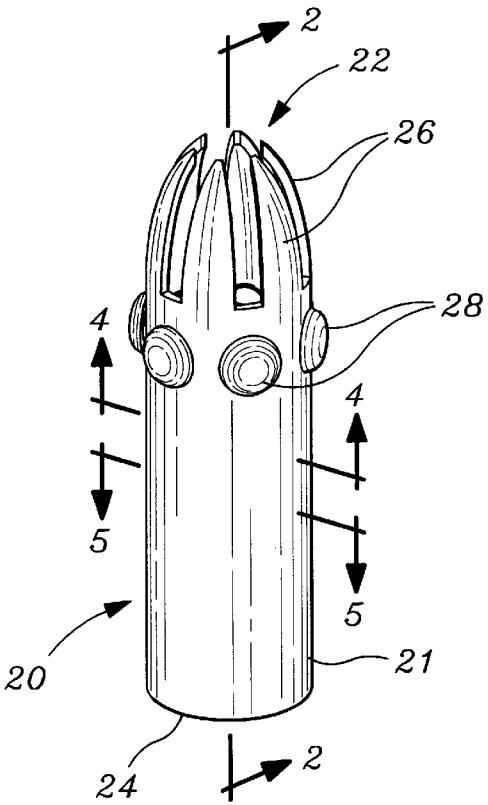
FIG. 1 is a diagrammatic perspective view of the accessory nozzle.

FIG. 1 illustrates an accessory nozzle 20 having a nozzle shell 21. The nozzle shell 21 is substantially cylindrical in shape, having an exit opening 22 and an entrance opening 24. The nozzle shell 21 has a plurality of nozzle fingers 26 near the exit opening 22. A plurality of coloring and flavoring nodules 28 extend through the nozzle shell 21 near the nozzle fingers 26.

Figure 2:
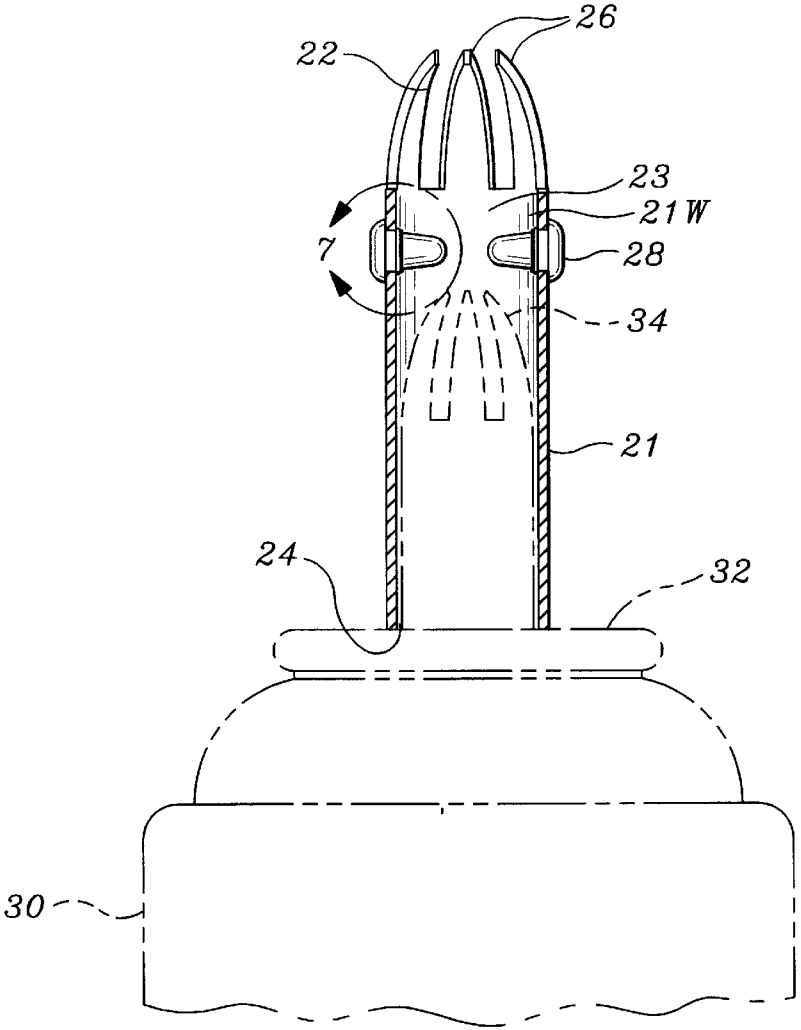
FIG. 2 is a cross sectional view taken along line 2—2 in FIG. 1.

FIG. 2 is a cross sectional view, depicting a whipped cream can 30 having a top 32 and a dispensing outlet 34 extending from the top 32, all shown in phantom. The nozzle shell 21 according to the invention has been placed fully over the dispensing outlet 34 of the whipped cream can 30 so that the entrance opening 24 reaches the top 32 of the can 30.

In FIG. 2 it can be seen that the nozzle shell 21 is substantially cylindrical from the entrance opening 24 until the nozzle fingers 26, which define the exit opening 22. The nozzle shell 21 includes a nozzle wall 21W, which defines the nozzle shell interior 23.

As illustrated in FIG. 2, whipped cream leaving the dispensing outlet 34 fills the nozzle interior, and then is forced out the exit opening 22. The nodules 28 extend into the nozzle shell 21 near the nozzle fingers 26 and the exit opening 22. Thus, the nodules 28 are effectively disposed in the path of whipped cream traveling through the nozzle shell 21.

Figure 3:
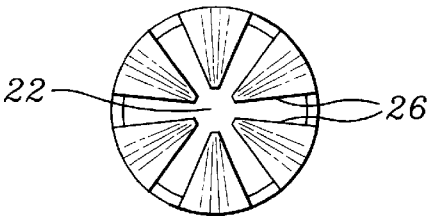
FIG. 3 is a top elevational view of the accessory nozzle.

FIG. 3 is a top plan view, illustrating the exit opening 22. The exit opening is formed by the nozzle fingers 26. Preferably there are six nozzle fingers 26, which leave an asterisk or star shaped opening therebetween. This form of opening allows a star shape to be extruded—a familiar characteristic of conventional whipped cream. The nodules 28 are preferably located immediately adjacent to the finger 26 and the exit opening in general, to avoid smearing the coloring on the extruded product. That is, the close proximity of the nodules to the exit opening allows the coloring and flavoring closely follow the extruded shape.

Figure 4:
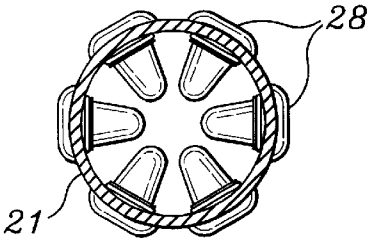
FIG. 4 is a cross sectional view, taken along line 4—4 in FIG. 1.
Figure 5:
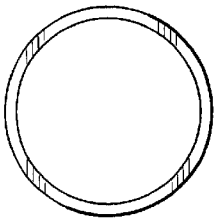
FIG. 5 is a cross sectional view, taken along line 5—5 in FIG. 1.

FIG. 4 is a cross sectional view taken along line 4—4 in FIG. 1. FIG. 4 shows a circumferential arrangement of nodules 28 evenly spaced around the nozzle shell 21. The nodules 28 extend radially inward, so that they nearly meet, and insure that they exert substantial interference with the whipped cream traveling through the nozzle shell 21, and contact a large surface area thereof.

Figure 6:
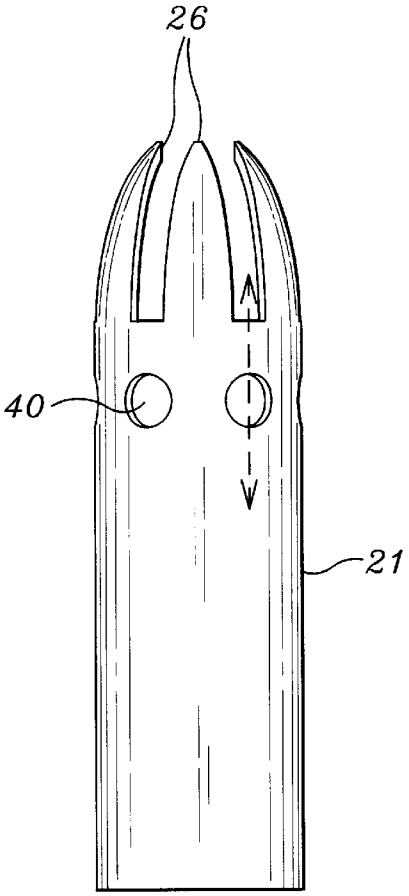
FIG. 6 is a front elevational view of the accessory nozzle, with the coloring and flavoring nodules removed.

FIG. 6 illustrates the nozzle shell 21 with the nodules 28 removed therefrom. The nozzle shell 21 has nodule sockets 40 which extend fully through the nozzle shell wall 21W to the nozzle interior 23, and are evenly spaced around the nozzle shell 21. The nodule sockets 40 each have a nodule socket diameter, and are preferably arranged so that they are each centered between two of the nozzle fingers 26.

Figure 7:
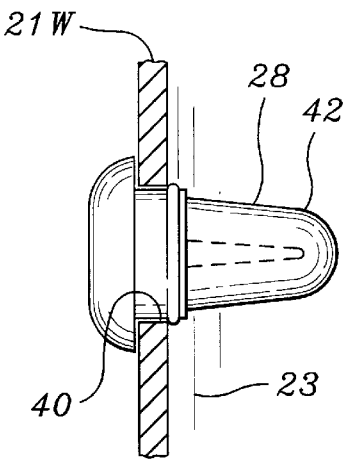
FIG. 7 is a cross sectional view of the nozzle wall with the coloring and flavoring nodule inserted therethrough.

FIG. 7 is an enlarged view, detailing one of the nodules 28 mounted in one of the nodule sockets 40 in the nozzle shell wall 21W.

Figure 8:
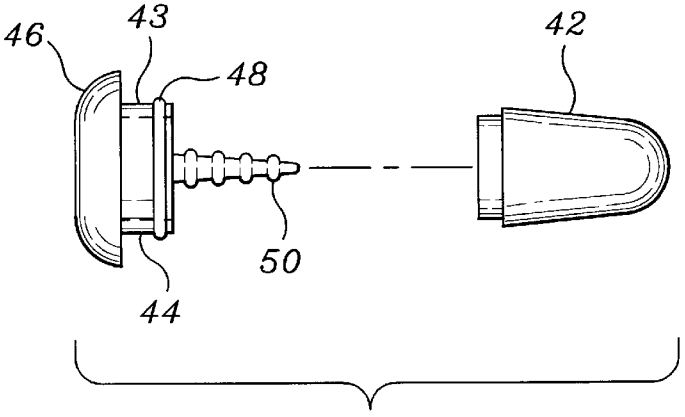
FIG. 8 is an exploded view, showing the components of the coloring and flavoring nodule.

Referring to FIG. 8, the nodule 28 comprises a substrate 42 and a holder 43. The holder 43 comprises a plug 44 which has a diameter which is substantially the same as the nodule socket diameter, and a flange 46 which is larger than the nodule socket diameter. The plug 44 also has a gasket ring 48 opposite the flange 46. The gasket ring 48 is slightly larger in diameter than the nodule socket diameter. However the gasket ring 48 is compressible, so that with sufficient manual force, the gasket ring 48 can be compressed to allow the plug 44 to extend into the socket 40 until the flange touches the nozzle shell wall 21W. However, the force of the whipped cream traveling through the accessory nozzle 20 is insufficient to compress the gasket ring 48 and push the nodule 28 out of its socket 40.

The holder 43 also has a shaft 50 for directly holding the substrate 42. The shaft 50 extends from the plug 44 in a direction opposite the flange 46. The shaft 40 may be notched to allow for a stronger structural bond between the shaft 40 and the substrate 42.

The substrate 42 in this embodiment is bell shaped, and contains the coloring and flavoring material which colors and flavors the whipped cream as it passes the nodule 28. The substrate can be a simple sugar and water mix, containing further flavorings and colorings according to the particular application and for achieving a desired effect. The mix is hardened into a solid having properties which allow it to slowly dissolve as the whipped cream contacts the substrate 42, flavoring and coloring the whipped cream in the process. Within the spirit of the invention, the self contained accessory nozzle can also employ liquid coloring and flavoring substances, contained within the nodule.

Referring to FIG. 7 once again, the nodule 28 is secured in the socket 40 by trapping the plug 44 between the flange 46 and the gasket ring 48. The substrate 42 extends into the nozzle interior 23.

Figure 11:
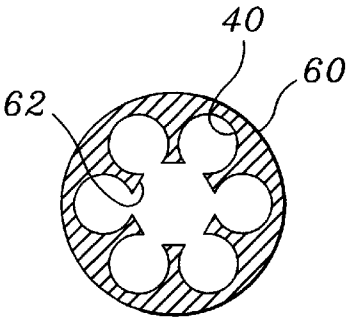
FIG. 11 is a cross sectional view of the second embodiment of the invention, taken along line 11—11 in FIG. 9.
Figure 10:
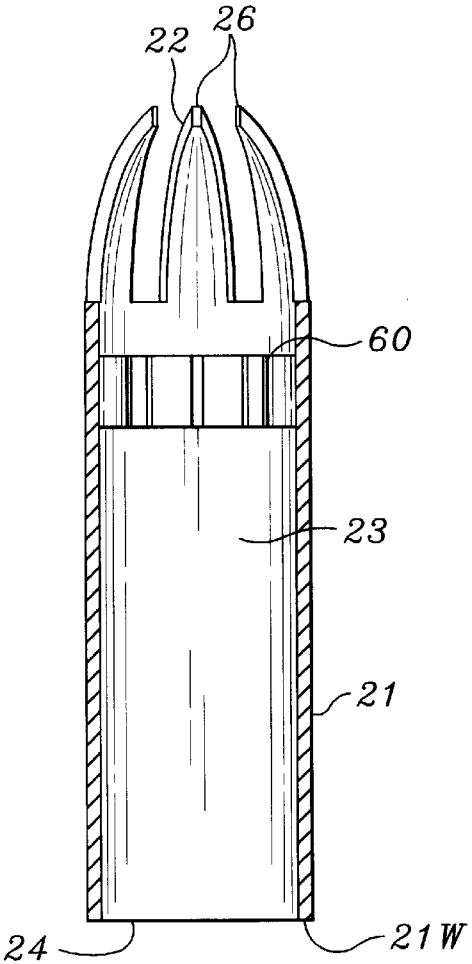
FIG. 10 is a cross sectional view of the nozzle according to a second embodiment of the invention, taken along line 10—10 in FIG. 9.
Figure 9:
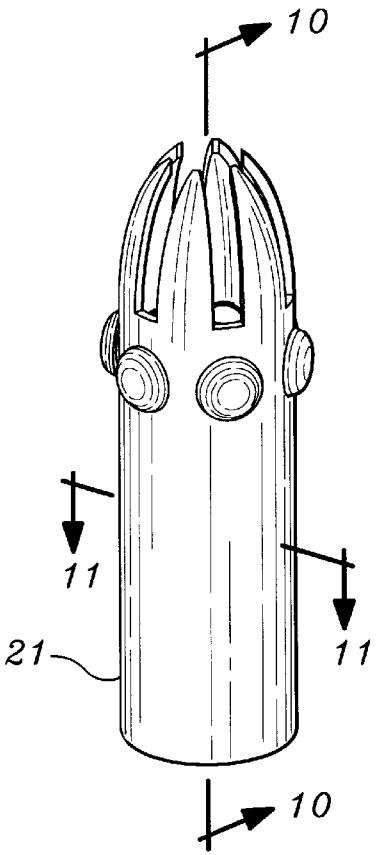
FIG. 9 is a diagrammatic perspective view of a second embodiment of the invention.

FIG. 10 and FIG. 11 depict a second embodiment of the invention, wherein the coloring and flavoring nodules 28 are located fully inside the nozzle shell 21.

According to the second embodiment, a cartridge 60 is located near the exit opening 22 and the nozzle fingers 26. The cartridge 60 divides the nozzle interior 23, acting as a barrier between the exit opening 22 and the nozzle interior 23 extending toward the entrance opening 24. The cartridge 60 is a short cylinder which may be integral within the nozzle shell wall 21W, or may be made to slide up into the nozzle shell 21, fitting snugly against the nozzle shell wall near the exit opening 22.

The cartridge 60 has a central opening 62 which preferably is polygonal in shape, said polygon having one side for each nozzle finger 26, and an equal number of corners. The nodule sockets 40 according to the second embodiment are cylindrical bores that extend vertically through the cartridge 60. The nodule sockets 40 are each tangential to one of the corners of the polygon wherein the nodule sockets 40 are in partial communication to the central opening 62 at the corners.

Figure 12:
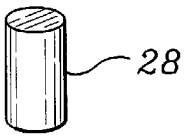
FIG. 12 is a diagrammatic perspective view of the nodule according to the second embodiment of the invention.

FIG. 12 illustrates the nodule 28, cylindrical in shape according to the second embodiment, so that the nodules fit tightly within the cylindrical nodule sockets 40 in the cartridge 60.

Figure 13:
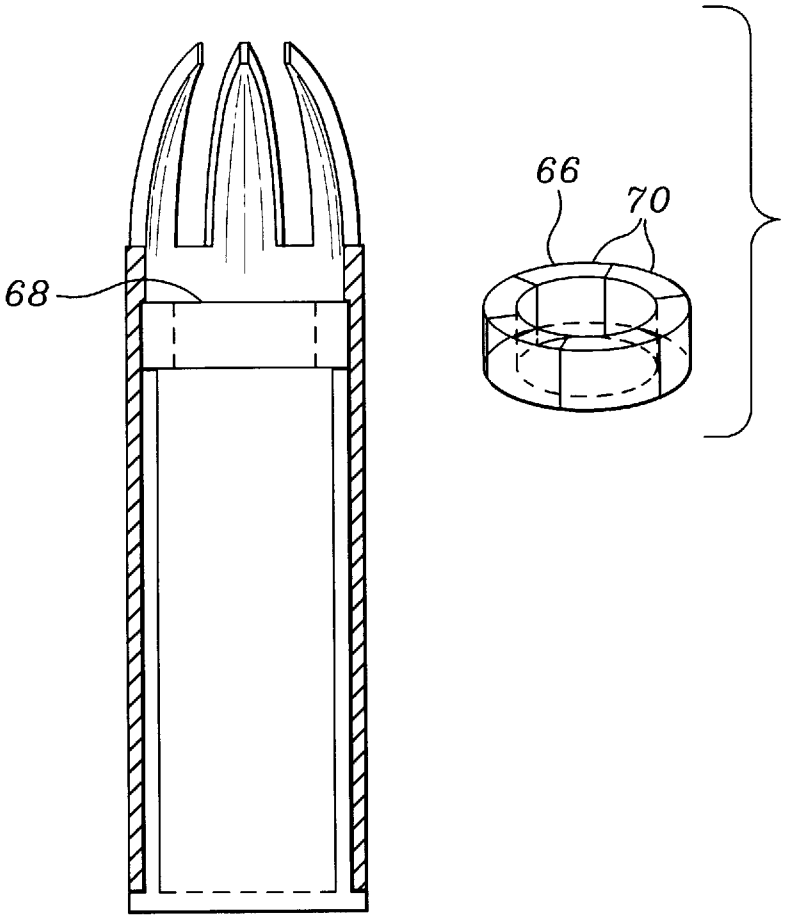
FIG. 13 is a cross sectional view of the nozzle according to a third embodiment, illustrating the flavoring and coloring ring.

FIG. 13 illustrates a third embodiment, in which the coloring and flavoring device is a color and flavor ring 66 which is inserted into the nozzle shell through the entrance opening, and is held in a ring recess 68 in the nozzle shell wall. The color and flavor ring 66 is divided into segments 70. The number of segments 70 should equal the number of nozzle fingers. Each segment 70 can contain different flavoring and coloring substances. Thus, for variety in flavoring and coloring, at least two of the segments 70 should contain different flavoring and coloring substances.

Figure 14:
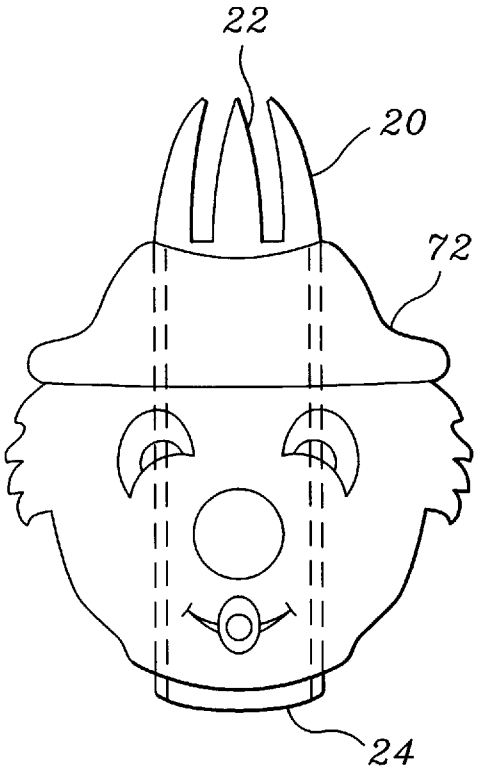
FIG. 14 is a front elevational view of a further embodiment of the invention, having a decorative outer casing.

FIG. 14 illustrates a further embodiment, in which the nozzle shell 20 is partially enclosed within a decorative formation 72. The decorative formation 72 might be a clown, or of some other recognizable character. The decorative formation 72 should clear both the exit opening 22 to avoid interference with the whipped cream exiting therefrom, and the entrance opening 24, to avoid interfering with the snug fit on the dispensing outlet.

In conclusion, herein is presented an accessory nozzle for use with a whipped cream can, that is self contained, and has internal provisions for flavoring and/or coloring the whipped cream exiting therefrom.

What is claimed is:

1. An accessory nozzle, for attaching onto a whipped cream can having a top and a dispensing outlet extending from the top, comprising:

a nozzle shell, substantially cylindrical in shape having a nozzle shell wall defining a nozzle interior, an exit opening, and an entrance opening that fits securely over the dispensing outlet;

a plurality of coloring and flavoring nodules attached in the nozzle wall, the nodules having a substrate which migrates to whipped cream traveling through the nozzle interior toward the exit opening to produce a desired effect selected from coloring and flavoring the whipped cream.

2. The accessory nozzle as recited in claim 1, wherein the nozzle shell further comprises a plurality of nodule sockets for receiving the nodules, said nodule sockets evenly spaced circumferentially around the nozzle interior.

3. The accessory nozzle as recited in claim 2, wherein the exit opening further comprises nozzle fingers which allow the whipped cream to form a non-cylindrical extruded shape, and wherein the nodules are arranged circumferentially around the nozzle interior so that each nodule corresponds directly to one of the nozzle fingers.

4. The accessory nozzle as recited in claim 3, wherein each nodule is centered between two of the nozzle fingers.

5. The accessory nozzle as recited in claim 2, wherein the nozzle sockets extend through the nozzle shell wall, and wherein the nodules further comprise a holder, the holder having a shaft onto which the substrate is attached.

6. The accessory nozzle as recited in claim 4, wherein the holder further comprises a plug that is substantially the same size as the nozzle socket, and a flange opposite the shaft, the flange large than the nozzle socket.

7. The accessory nozzle as recited in claim 2, further comprising a cartridge located within the nozzle shell interior, the cartridge having a central opening wherein the nozzle sockets are cylindrical bores extending vertically through the cartridge, the nodules are cylinders which fit within the sockets.

8. The accessory nozzle as recited in claim 7, wherein the exit opening further comprises nozzle fingers which cause the whipped cream to form a non-cylindrical extruded shape, and wherein the central opening is polygonal in shape having sides and corners where said sides meet, the number of sides equal to the number of nozzle fingers, the nodules are arranged circumferentially around the central opening so that each nodule socket is located at one of the corners.

9. The accessory nozzle as recited in claim 8, wherein the flavoring and coloring nodules are arranged in a ring, each of the nodules representing a segment in said ring, the nozzle wall having a recess near the exit opening for holding said ring within the nozzle wall interior.

10. An accessory nozzle, for attaching onto a whipped cream can having a top and a dispensing outlet extending from the top, comprising:

a nozzle shell, having a nozzle shell wall defining a nozzle interior, an exit opening, and an entrance opening that fits securely over the dispensing outlet;

a coloring and flavoring device self contained within the nozzle shell, the coloring and flavoring device interacting with whipped cream traveling through the nozzle interior toward the exit opening to produce a desired effect selected from coloring and flavoring the whipped cream.

11. The accessory nozzle as recited in claim 10, wherein the coloring and flavoring device further comprises coloring and flavoring nodules disposed within the nozzle shell, said nodules having a substrate which migrates to the whipped cream to create the desired effect.

12. The accessory nozzle as recited in claim 11, wherein the nozzle shell further comprises a plurality of nodule sockets for receiving the nodules, said nodule sockets evenly spaced circumferentially around the nozzle interior.

13. The accessory nozzle as recited in claim 12, wherein the exit opening further comprises nozzle fingers which allow the whipped cream to form a non-cylindrical extruded shape, and wherein the nodules are arranged circumferentially around the nozzle interior so that each nodule corresponds directly to one of the nozzle fingers.

14. The accessory nozzle as recited in claim 13, wherein each nodule is centered between two of the nozzle fingers.

15. The accessory nozzle as recited in claim 12, wherein the nodule sockets extend through the nozzle shell wall, and wherein the nodules further comprise a holder, the holder having a shaft onto which the substrate is attached.

16. The accessory nozzle as recited in claim 14, wherein the holder further comprises a plug that is substantially the same size as the nozzle socket, and a flange opposite the shaft, the flange large than the nozzle socket.

17. The accessory nozzle as recited in claim 10, wherein the coloring and flavoring device is a ring having a plurality of segments, the nozzle shell wall having a ring recess for holding said ring within the nozzle interior near the exit opening.

18. The accessory nozzle as recited in claim 17, wherein at least two of the segments contain different coloring and flavoring substances.

19. The accessory nozzle as recited in claim 11, further comprising a cartridge located within the nozzle shell interior, the cartridge having a central opening wherein the nozzle sockets are cylindrical bores extending vertically through the cartridge, the nodules are cylinders which fit within the sockets.

20. The accessory nozzle as recited in claim 19, wherein the exit opening further comprises nozzle fingers which allow the whipped cream to form a non-cylindrical extruded shape, and wherein the central opening is polygonal in shape having sides and corners where said sides meet, the number of sides equal to the number of nozzle fingers, the nodules are arranged circumferentially around the central opening so that each nodule socket is located at one of the corners.

* * * * *